US005475959A

United States Patent [19]

Mackenzie

[11] Patent Number: 5,475,959

[45] Date of Patent: Dec. 19, 1995

[54] FLOOR CONSTRUCTION

[75] Inventor: Robin K. Mackenzie, Edinburgh, United Kingdom

[73] Assignee: Edinburgh Acoustical Co. Ltd., Scotland, United Kingdom

[21] Appl. No.: 129,042

[22] PCT Filed: May 23, 1991

[86] PCT No.: PCT/GB91/00810

§ 371 Date: Jan. 29, 1993

§ 102(e) Date: Jan. 29, 1993

[87] PCT Pub. No.: WO91/19064

PCT Pub. Date: Dec. 12, 1991

[30] Foreign Application Priority Data

Jun. 2, 1990 [GB] United Kingdom ..... 9012368

[51] Int. Cl.[6] ..... E04F 15/14

[52] U.S. Cl. ..... 52/403.1

[58] Field of Search ..... 52/403.1, 480, 52/483.1

[56] References Cited

U.S. PATENT DOCUMENTS

| | | | |
|---|---|---|---|
| 2,016,566 | 10/1935 | Winship | 52/483.1 |
| 2,107,240 | 2/1938 | Eilertsen | 52/483.1 |
| 3,983,081 | 9/1976 | Dieterich et al. | 260/2.5 AJ |
| 4,154,042 | 5/1979 | Epes | 52/798 |
| 4,644,720 | 2/1987 | Schneider | 52/403.1 |
| 4,854,099 | 8/1989 | Kristofferson | 52/403.1 |
| 4,879,856 | 11/1989 | Jones et al | 52/403.1 |
| 4,910,936 | 3/1990 | Aberdroth et al. | 52/403.1 |

FOREIGN PATENT DOCUMENTS

| | | | |
|---|---|---|---|
| 175933 | 6/1935 | Switzerland | 52/403.1 |

*Primary Examiner*—Carl D. Friedman
*Assistant Examiner*—Creighton Smith
*Attorney, Agent, or Firm*—Gifford, Krass, Groh, Sprinkle, Patmore, Anderson & Citkowski

[57] ABSTRACT

A floor construction on a support means of timber joists (10) consists of floor boards (11, 12) laid on battens (13) each having a lower horizontal surface faced with a material (14) for attenuating transmission of sound. The battens (13) consist of plywood strips about 5 mm thick and the same width as the joists. (10). The battens (13) are less stiff than the floor boards (11, 12). Thus, energy delivered to the sound attenuating material (14) is increased. The material (14) included open-cell and closed-cell layers (14B, 14A); and the upper layer (14A) has lateral flaps (15) folded down and nailed to the sides of the joists (10). The floor construction has improved sound attenuating qualities; the reduced batten thickness allows easier installation in certain circumstances; and the lateral flaps also assist installation.

12 Claims, 2 Drawing Sheets

FLOOR CONSTRUCTION

FIELD OF THE INVENTION

This invention relates to a floor construction and to a method of installing a floor, and to a product for use in such construction and method.

BACKGROUND OF THE INVENTION

According to the present invention, there is provided a floor construction comprising support means, mutually spaced battens supported on the support means, a resiliently pliant sound deadening material interposed between the battens and the support means, and floorboards laid on the battens, the battens having a first stiffness value, the floorboards having a second stiffness value, the first stiffness value being less than the second stiffness value.

Conventionally, flooring battens are stiffer than floor boards. Such battens usually are timbers of square cross-section, 50 mm×50 mm. Reducing the stiffness of the battens relative to the stiffness of the floor boards generally increases the energy delivered to the sound attenuating material upon the occurence of sound-generating impacts on the floor boards. This increase results in improved floor flexibility and improved sound attenuation. Also, the vertical dimension between the support means and the top surface of the floor boards is reduced with advantage in relation to adjustments to existing fittings such as doors, skirtings, when the floor construction is used in rehabilitation.

SUMMARY OF THE INVENTION

Preferably, the support means comprises timber joists, and the sound attenuating material defines lateral flaps which are folded to lie against and are secured to the joists.

The flaps facilitate the installation of the floor by being easily secured to the joists by nailing or stapling so as to position and hold the battens during subsequent laying of the floor boards.

BRIEF DESCRIPTION OF THE DRAWINGS

Embodiments of the present invention will now be described, by way of example, With reference to the accompanying drawings in which.

DETAILED DESCRIPTION OF THE PREFERRED EMBODIMENTS

Figure 1:
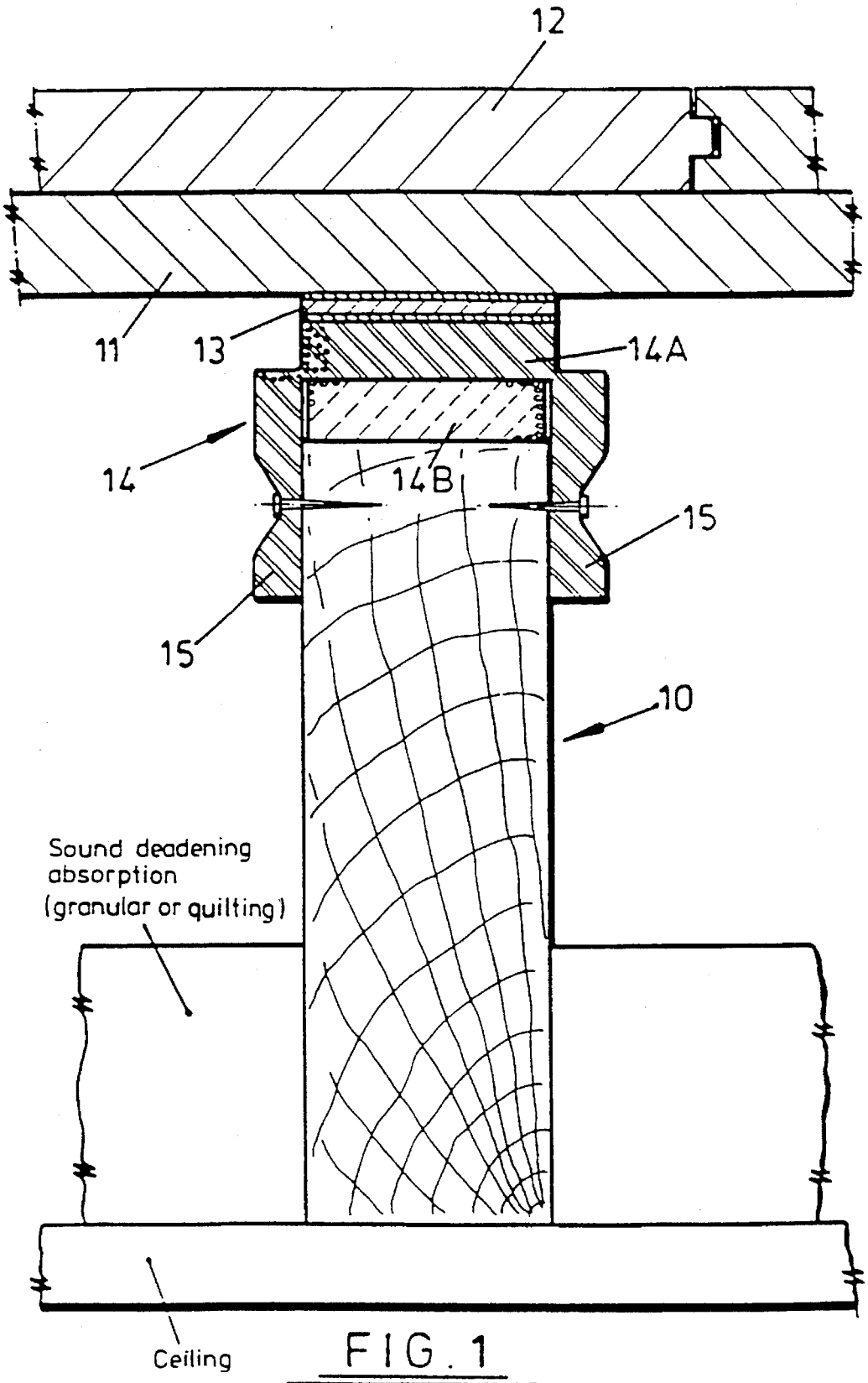
FIG. 1 is sectional elevation of part of a floor construction in accordance with the present invention.

In FIG. 1 the floor construction is supported on support means in the form of timber joists one of which is indicated by reference numeral 10. The timber joists are generally of standard cross-section, 50 mm×225 mm.

The floor construction consists of floor boards 11, 12 laid on relatively thin battens 13 to the under side of which is secured material, indicated generally by reference numeral 14, for attenuating transmission of sound into the joist 10 or within the floor cavity.

More particularly, the floor boards 11, 12 are 19 mm GYPROC planks 11 which are secured to the battens 13 by means of an adhesive (not shown); and mutually interengaging 19 mm chipboard panels 12. The battens 13 are of 4.5 mm plywood approximately the same width as the joists 10.

The sound attenuating material 14 consists of an upper layer 14A which is secured to the underside of the batten 13 by adhesive, and a lower layer 14B which is secured to the upper layer also by means of adhesive. Both the upper layer and the lower layer are of resiliently pliant cellular materials, and the upper layer 14A is of closed-cell structure and the lower layer 14B is of open-cell structure. Such structures are well-known in the industry concerned with the production of cellular polymer materials. The upper layer 14A is approximately of 10 mm thickness, and the lower layer 14B is approximately of 12 mm thickness. Under normal floor loadings, the lower layer 14B will compress to about 3 to 4 mm thickness.

The upper layer of closed-cell material 14A incorporates lateral flaps 15 which extend beyond the batten 13. In the course of installing the floor construction, the battens are placed on the joists parallel therewith and with the sound attenuating material in contact with the joists, and the flaps 15 are folded downwards to lie against the sides of the joists and are secured thereto by means of nailing or stapling as can be seen in FIG. 1. Thus, the battens 13 complete with the sound attenuating material are easily and readily positioned and held during subsequent installation of the floor boards 11, 12.

Figure 2:
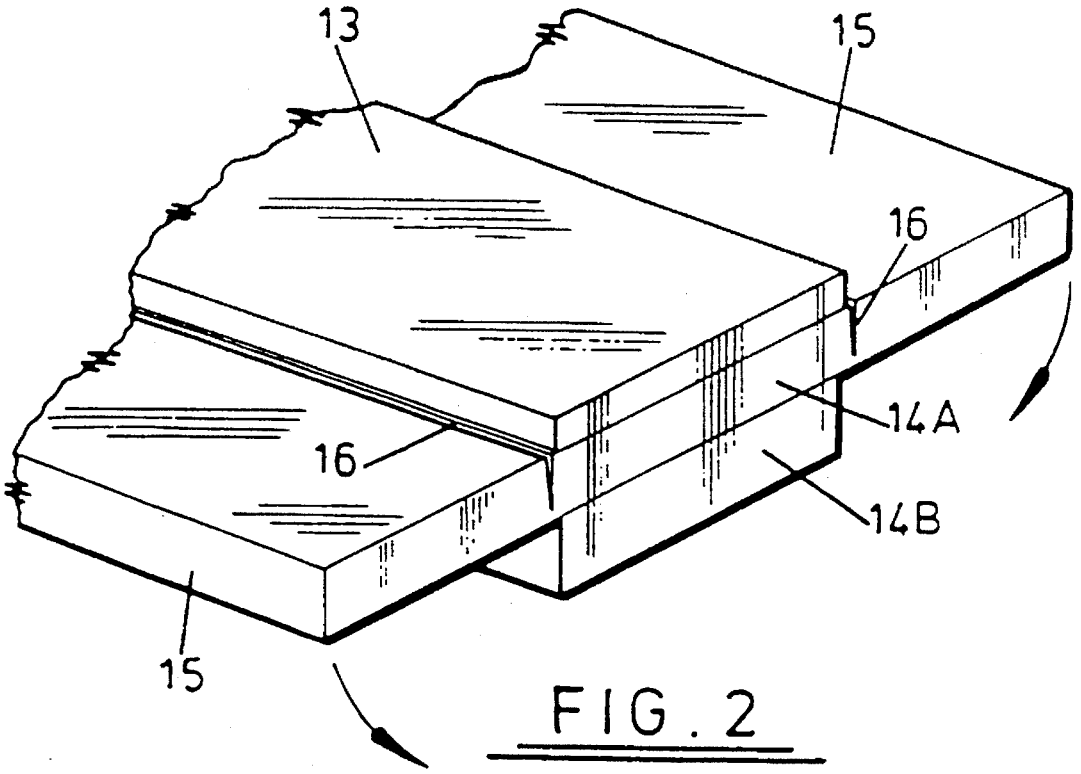
FIG. 2 is a perspective view of an end portion of a product for use in the floor construction of FIG. 1.

In FIG. 2, parts corresponding with those seen in FIG. 1 are given the same reference numerals. In FIG. 2, the product is shown with the flaps 15 non folded down. Thus, the product is more easily and more economically packed. To facilitate folding of the flaps 15, the upper layer 14A has mutually parallel cuts 16 to a depth of about 7 to 8 mm, one adjacent each side of the batten 13.

In one modification of the product, the flaps 15 are dispensed with in the case where the supports means is in the form of a concrete sub-floor.

In a modification of the flooring construction described above, the planks 11 are dispensed with.

I claim:

1. In a floor construction including a batten overlying a support and floor boards overlying the batten, the improvement comprising: a resiliently pliant sound attenuating material interposed between the batten and the support, the batten having a first stiffness value, the floorboards having a second stiffness value, the first stiffness value being less than the second stiff value.

2. A floor construction according to claim 1, wherein the batten is a plywood strip having a first thickness dimension, the floorboards having a second thickness dimension, and the first thickness dimension is less than the second thickness dimensions.

3. A floor construction according to claim 2, wherein the said plywood strip has a thickness dimension in a range 4 mm to 6 mm.

4. A floor construction according to claim 1, wherein the floorboards are secured to the batten.

5. A floor construction according to claim 4, wherein the floorboards are secured to the batten by means of an adhesive.

6. A floor construction according to claim 1, wherein the floorboards comprise mutually inter-engaged panels.

7. A floor construction according to claim 6, wherein the floorboard comprise planks disposed between the panels and the batten.

8. A floor construction according to claim 1, wherein the sound attenuating material is a cellular material.

9. A floor construction according to claim 1, wherein the sound attenuating material comprises an upper layer and a lower layer of cellular materials of which the cells in one layer are open cells and the cells in the other layer are closed cells.

10. A floor construction according to claim 9, wherein the closed-cell layer is the upper layer and is secured to its respective batten by means of an adhesive.

11. A floor construction according to claim 1, wherein the support means comprises timber joists.

12. A floor construction according to claim 11, wherein the sound attenuating material defines lateral flaps which are folded to lie against and are secured to the joists.

* * * * *